US005118998A

United States Patent [19]

Garbowicz

[11] Patent Number: 5,118,998

[45] Date of Patent: Jun. 2, 1992

[54] MULTI-TAP PRIMARY COIL FOR GAS DISCHARGE LAMPS

[75] Inventor: Glenn D. Garbowicz, Rosemont, Ill.

[73] Assignee: North American Philips Corporation, New York, N.Y.

[21] Appl. No.: 377,502

[22] Filed: Jul. 10, 1989

[51] Int. Cl.[5] ..... H05B 41/16; H01F 27/28

[52] U.S. Cl. ..... 315/278; 315/276; 315/282; 336/190; 336/188

[58] Field of Search ..... 315/276, 277, 278, 70, 315/354, 282; 336/170, 171, 90, 96, 69, 70, 190, 188, 192

[56] References Cited

U.S. PATENT DOCUMENTS

| | | | |
|---|---|---|---|
| 2,563,595 | 8/1951 | Feinberg | 315/282 |
| 3,242,381 | 3/1966 | Davis, Jr. | 336/190 X |
| 4,184,103 | 1/1980 | Stein | 315/276 |

FOREIGN PATENT DOCUMENTS

| | | |
|---|---|---|
| P42405D | 3/1951 | Fed. Rep. of Germany . |
| 1033335 | 3/1951 | France . |
| 1086186 | 10/1967 | United Kingdom . |

*Primary Examiner*—Eugene R. LaRoche
*Assistant Examiner*—Ali Neyzari
*Attorney, Agent, or Firm*—Robert T. Mayer

[57] ABSTRACT

A multi-tap ballast including wires of two gauges connected to each other to provide a smaller package than previously could be obtained.

10 Claims, 1 Drawing Sheet

MULTI-TAP PRIMARY COIL FOR GAS DISCHARGE LAMPS

This is an invention in the lighting art. More particularly, it relates to a multi-tap primary coil winding for gas discharge lamps using at least two different gauges of wire.

It is common practice in the lighting industry to provide a standard multi-tap ballast which is suitable for various line voltages. In the past when 120 volt and 240 volt line voltages might be encountered a standard sized package ballast was provided. Upon encountering a 347 volt line voltage, however, the standard package for 120 volt and 240 volt line voltages had to be increased in size to provide the windings necessary for the 347 volt line. This, of course, required more space for a 347 volt ballast than for a maximum 277 volt ballast.

It is an object of this invention to provide an improved multi-tap ballast primary coil.

One of the features of the invention is the provision of a multi-tap ballast primary coil which includes both precision wound coils and random round coils.

Another feature of the invention is the provision of a ballast primary with coils of at least two different sized wire gauges.

One of the advantages of the invention is that a multi-tap ballast suitable for a voltage as high as 347 volts was fitted within the same space as previous ballast primaries suitable for only 277 volts.

In accordance with the invention there is provided a multi-tap ballast primary coil for gas discharge lamps including a coil with a plurality of windings. Some of these windings include precision wound turns and others include random wound turns. The random wound turns encircle the precision wound turns and are electrically connected thereto.

In accordance with another aspect of the invention there is provided a multi-tap ballast primary coil for gas discharge lamps which have substantially the same dimensions as previous ballast reactances. This novel ballast primary coil is capable of operation with a voltage substantially higher than any voltage previous ballasts of the same dimension are capable of operating with.

Other objects, features, and advantages of the invention will be apparent from the following description and appended claims when considered in conjunction with the accompanying drawing in which:

Figure 1:
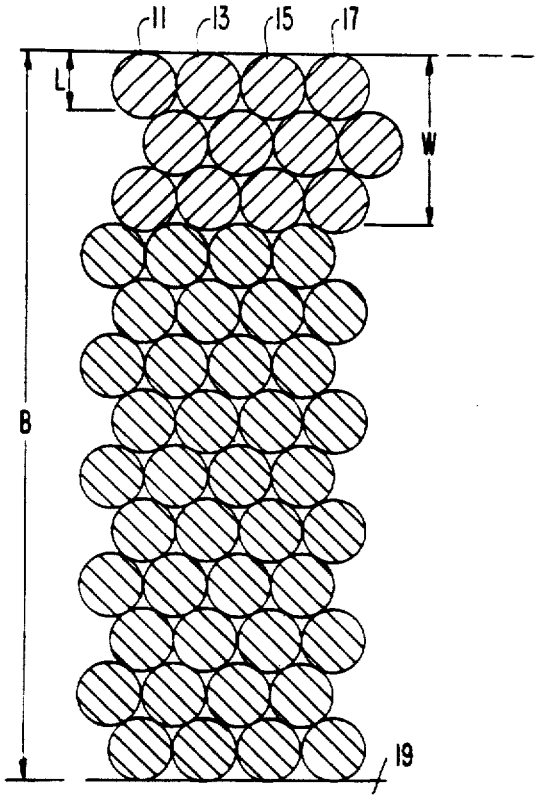
FIG. 1 PRIOR ART
FIG. 1 is the cross section of a winding build of a representative previous ballast primary coil.

Referring to FIG. 1 there is shown in cross-section a representation of the winding build of a multi-tap ballast reactance suitable for voltages up to 277 volts. As can be seen four windings such as 11, 13, 15 and 17 are contained in each layer of the coil. The height B of the winding build of such a coil is 0.630 inches. As those skilled in the art will understand the coil of FIG. 1 is wound on a steel core 19. Typically the ballast of FIG. 1 is furnished in a housing with a width of 6 inches, a height of 4¼ inches and a length of 3⅛ inches.

Figure 2:
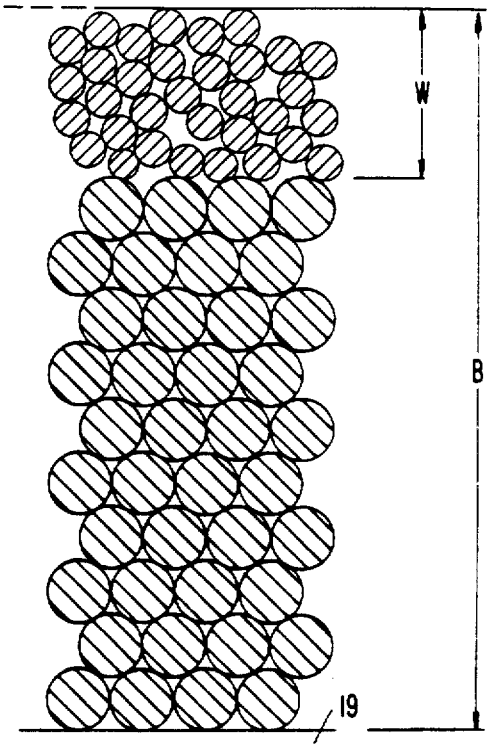
FIG. 2 is a cross-section of a winding build of a ballast primary coil constructed in accordance with the present invention.

By comparing FIG. 2 with FIG. 1, it can be seen that the ballast primary coil of FIG. 2 is identical to that of FIG. 1 for the first 10 layers of the coil. In a constructed embodiment each of these layers contained 23 turns of 15½ copper heavy build wire. In the window W of 0.122 inches, 102 turns of 20 gauge copper heavy build wire was random wound in approximately 5 layers. By using window W for a higher gauge winding as opposed to continuing to precision wind the same gauge wire throughout the coil, the same size coil was found to be capable of operating with 347 volts of line voltage whereas previously that size coil could not be used for any line voltage higher than 277 volts.

Previously, the winding build for an equivalent multi-tap 347 volt primary coil would have had to have been approximately 0.725 inches. With the present invention, a 347 volt multi-tap ballast reactance is fitted into a winding build of 630 inches, which is the same winding build as previous 277 volt ballasts. It should be understood that the thermal performance of this multi-gauge wire coil is the equivalent of previous all precision wound coils.

It is also to be understood that this multi-gauge wire coil with its core 19 also fits into a package which is 6 inches wide, 4¼ inches high and 3⅛ inches long just as the all precision wound 277 volt multi-tap ballast does. Although a window W of 0.122 inches was available above the first 10 layers of the coil of FIG. 2 it is to be understood that only 0.110 inches was needed to accommodate the random wound turns.

Figure 3:
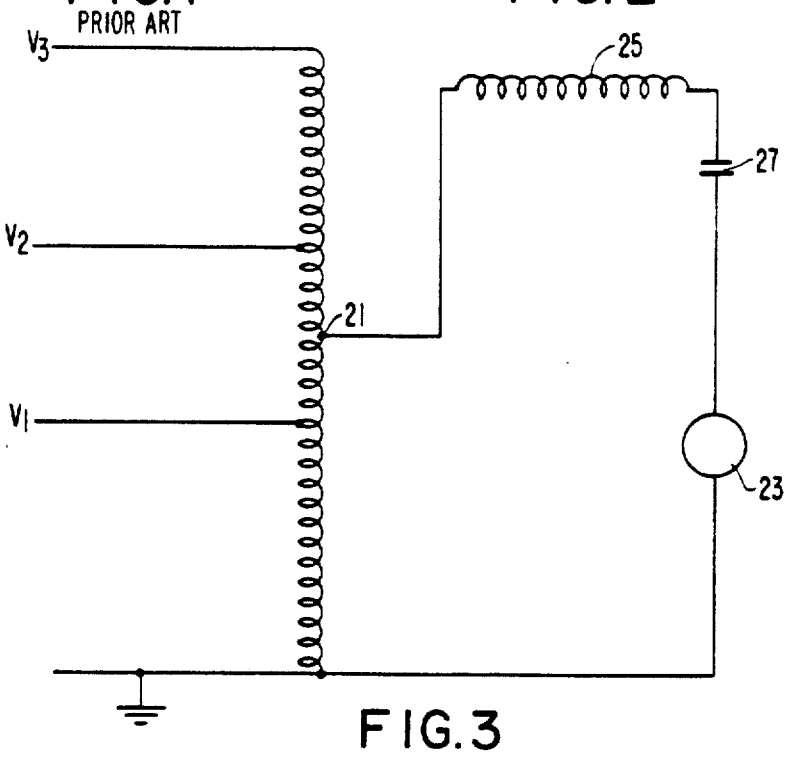
FIG. 3 is a wiring diagram of a standard lighting circuit using the ballast primary coil of the invention.

It is also to be understood that the random wound turns provided between connection $V_2$ and $V_3$ of FIG. 3 are, as shown, connected to the precision wound coils shown in FIG. 3 connected between connection $V_2$ and ground. In a constructed embodiment, connection lines $V_1$, $V_2$ and $V_3$ represent a 120 volt connection, a 240 volt connection and a 347 volt connection, respectively. 15½ gauge copper wire of the coil of FIG. 2 was provided between the 240 volt connection $V_2$ and ground. 20 gauge copper wire was provided between the 347 volt connection $V_3$ and the 240 volt connection $V_2$. Tap 21 is provided between the 120 volt connection $V_1$ and the 240 volt connection $V_2$ as is suitable for lamp 23. In the constructed embodiment, coil 25 was 11 layers of 36 turns per layer 14½ gauge copper heavy build wire connected between tap 21 and capacitor 27.

It should be apparent that various modifications of the above will be evident to those skilled in the art and that the arrangement described herein is for illustrative purposes and is not to be considered restrictive.

What is claimed is:

1. A coil for use in a multi-tap ballast for gas discharge lamps, said coil including a plurality of precision wound turns and a plurality of random wound turns clustered haphazardly on top of one another encircling said precision wound turns and electrically connected thereto.

2. A multi-tap ballast coil as claimed in claim 1, wherein said random wound turns and said precision wound turns comprise wires of different gauges.

3. A multi-tap ballast coil as claimed in claim 2, wherein the gauge of the wire of said random wound turns is larger than the gauge of the wire of said precision wound turns.

4. A multi-tap ballast primary coil for gas discharge lamps having substantially the same dimensions as prior art ballast primary coils and capable of operation with a voltage substantially higher than any voltage said prior art ballast primary coils of said same dimensions are capable of operating with, said coil including a plurality of precision wound turns and a plurality of random wound turns.

5. A multi-tap ballast primary coil as claimed in claim 4, wherein said substantially higher voltage is 347 volts and said any voltage is 277 volts.

6. A ballast primary coil for gas discharge lamps including a plurality of wound turns of a first gauge and a plurality of wound turns of a second gauge different than said first gauge clustered haphazardly on top of one another encircling said turns of said first gauge and electrically connected thereto.

7. A multi-tap primary coil as claimed in claim 6, wherein the gauge of the wires of said first gauge is smaller than the wires of said second gauge.

8. A coil with a plurality of precision wound turns and a plurality of random wound turns clustered haphazardly on top of one another encircling said precision wound turns and electrically connected thereto.

9. A coil as claimed in claim 8, wherein said random wound turns and said precision wound turns comprise wires of different gauges.

10. A coil as claimed in claim 9, wherein the gauge of the wire of said random wound turns is larger than the gauge of the wire of said precision wound turns.

* * * * *